US009084468B2

(12) United States Patent
Conwell

(10) Patent No.: US 9,084,468 B2
(45) Date of Patent: Jul. 21, 2015

(54) SYSTEM FOR INTEGRATING A PORTABLE ELECTRONIC DEVICE WITH A BOTTLE OR ARM HOLDER AND FOR MODIFICATION OF BOTTLES

(71) Applicant: Scott A. Conwell, Crofton, MD (US)

(72) Inventor: Scott A. Conwell, Crofton, MD (US)

( * ) Notice: Subject to any disclaimer, the term of this patent is extended or adjusted under 35 U.S.C. 154(b) by 0 days.

(21) Appl. No.: 13/842,797

(22) Filed: Mar. 15, 2013

(65) Prior Publication Data

US 2014/0263487 A1 Sep. 18, 2014

(51) Int. Cl.

| | |
|---|---|
| ***A45F 3/16*** | (2006.01) |
| ***B65D 23/12*** | (2006.01) |
| ***A45F 5/00*** | (2006.01) |
| ***A45F 3/18*** | (2006.01) |
| *B65D 21/02* | (2006.01) |

(52) U.S. Cl.

CPC ... *A45F 5/00* (2013.01); *A45F 3/18* (2013.01); *A45F 2005/008* (2013.01); *A45F 2200/0516* (2013.01); *B65D 21/0237* (2013.01); *B65D 23/12* (2013.01)

(58) Field of Classification Search

USPC ..... 224/255, 148.1–148.6, 414, 222, 267, 224/929, 930; 215/386, 390; 220/735, 675; D12/411

See application file for complete search history.

(56) References Cited

U.S. PATENT DOCUMENTS

| | | | | | |
|---|---|---|---|---|---|
| 3,732,999 | A | * | 5/1973 | Rounkles | 215/6 |
| 4,272,768 | A | * | 6/1981 | Rookard, Jr. | 342/7 |
| 4,550,848 | A | * | 11/1985 | Sucato | 220/501 |
| 4,773,032 | A | * | 9/1988 | Uehara et al. | 708/134 |
| 5,351,851 | A | * | 10/1994 | Powell | 220/503 |
| 5,413,261 | A | * | 5/1995 | Wu | 224/148.4 |
| 5,419,154 | A | * | 5/1995 | Christoff | 62/457.3 |
| 5,427,259 | A | * | 6/1995 | Krastanov | 215/11.1 |
| 5,433,416 | A | * | 7/1995 | Johnson | 248/475.1 |
| 5,484,128 | A | * | 1/1996 | Franco, Sr. | 248/311.2 |
| 5,624,064 | A | * | 4/1997 | McGee, Jr. | 224/414 |
| 5,669,329 | A | * | 9/1997 | Krause | 119/72.5 |
| 5,745,565 | A | * | 4/1998 | Wakefield | 379/446 |
| 5,890,636 | A | * | 4/1999 | Kibbe | 224/148.6 |
| 5,988,464 | A | * | 11/1999 | Butler et al. | 224/148.4 |
| 6,053,759 | A | * | 4/2000 | Kunert | 439/376 |
| 6,065,624 | A | * | 5/2000 | Steinke | 215/383 |
| 6,092,707 | A | * | 7/2000 | Bowes, Jr. | 224/435 |
| 6,588,593 | B2 | * | 7/2003 | Woskoski | 206/459.1 |
| 6,588,622 | B1 | * | 7/2003 | Leishman et al. | 220/719 |
| 6,685,047 | B1 | * | 2/2004 | Mott et al. | 220/753 |
| 6,695,163 | B2 | * | 2/2004 | Michalowski | 215/398 |
| 6,837,407 | B1 | * | 1/2005 | Towers et al. | 224/424 |
| D507,174 | S | * | 7/2005 | Katz et al. | D9/738 |
| 7,158,376 | B2 | * | 1/2007 | Richardson et al. | 361/679.56 |
| 7,300,171 | B2 | * | 11/2007 | Sutton | 362/101 |
| D575,583 | S | * | 8/2008 | Morgan | D7/510 |
| 7,929,297 | B2 | * | 4/2011 | Chen | 361/679.56 |
| 8,016,107 | B2 | * | 9/2011 | Emsky | 206/320 |
| 8,033,409 | B2 | * | 10/2011 | Lindemann | 220/4.21 |
| D658,006 | S | * | 4/2012 | Yao | D7/505 |
| 2005/0081879 | A1 | * | 4/2005 | Andrion | 132/308 |
| 2005/0133557 | A1 | * | 6/2005 | McKenzie et al. | 224/547 |
| 2008/0149589 | A1 | * | 6/2008 | Lach | 215/386 |
| 2010/0264152 | A1 | * | 10/2010 | Hirst et al. | 220/735 |

* cited by examiner

*Primary Examiner* — Justin Larson
(74) *Attorney, Agent, or Firm* — Conwell Law LLC

(57) ABSTRACT

The present invention is drawn to a device for concurrently holding, displaying and transporting a combination of complementary devices, including one or more portable electronic devices with a water-type beverage bottle or arm holder and the modification of bottles such that on-screen touch operations with the device are readily made even when the device is attached to the body. Another embodiment is a water-type beverage bottle modified to contain internal baffles and attachment mechanisms.

8 Claims, 5 Drawing Sheets

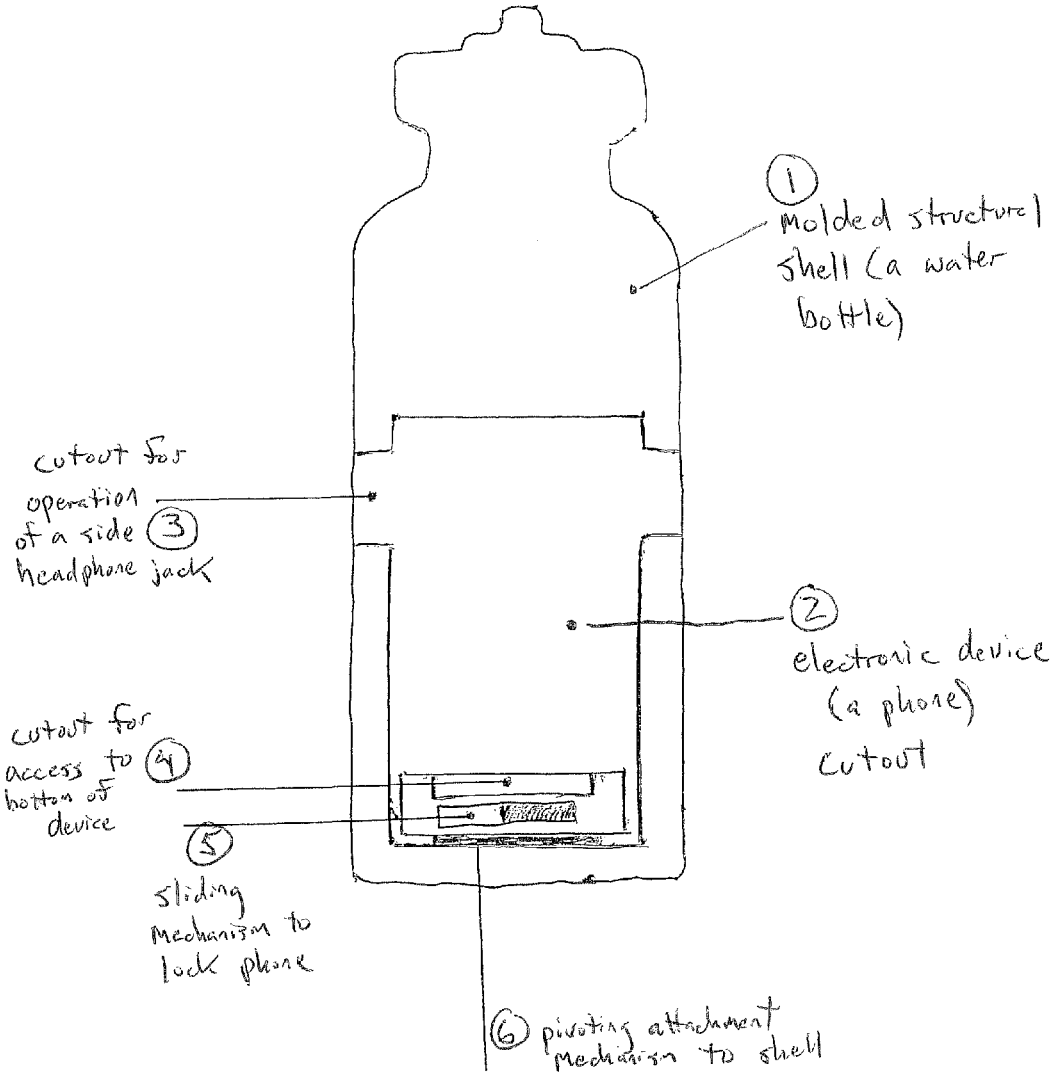
Fig. 1 (Front View)

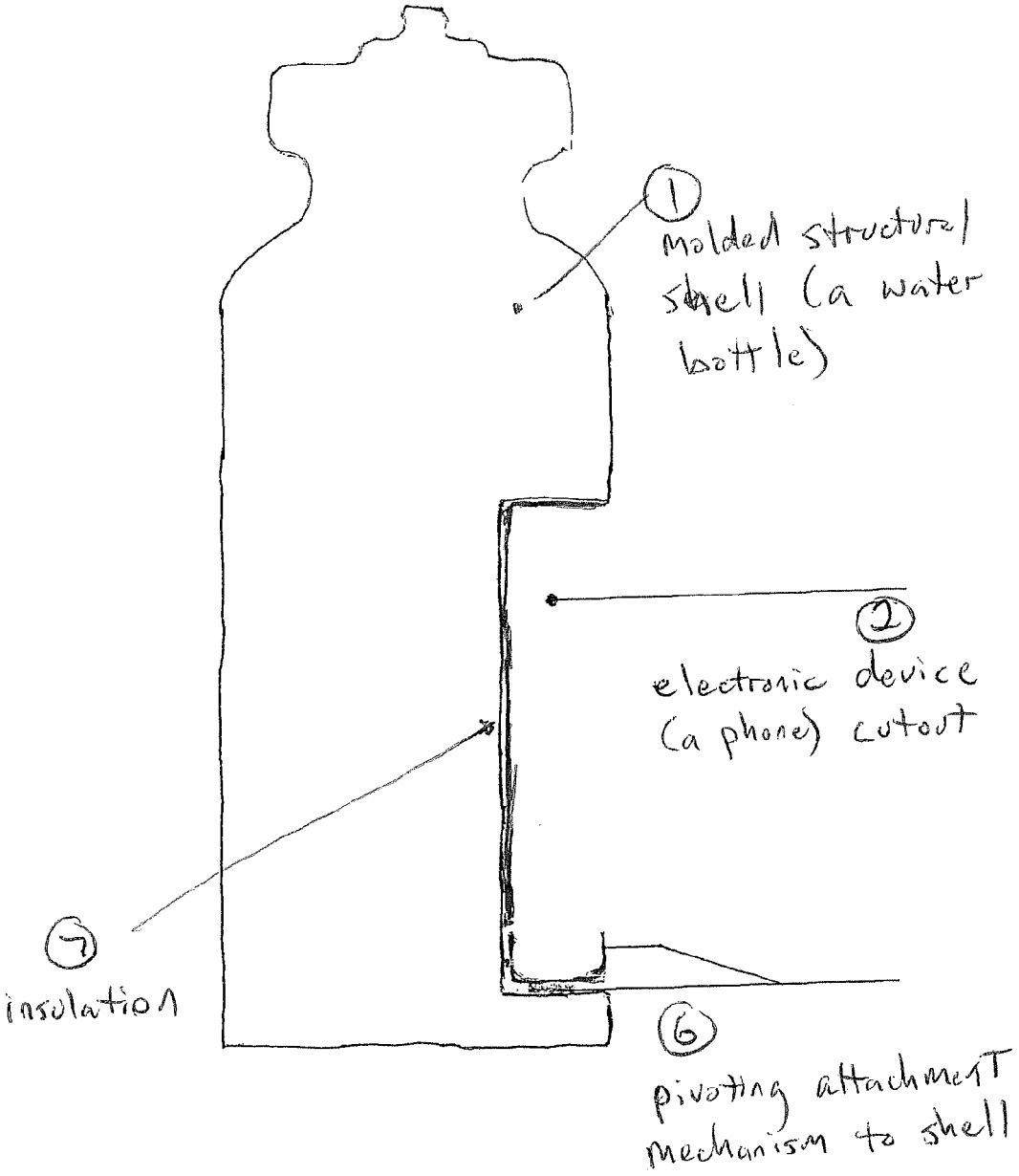
Fig. 2 (Side View)

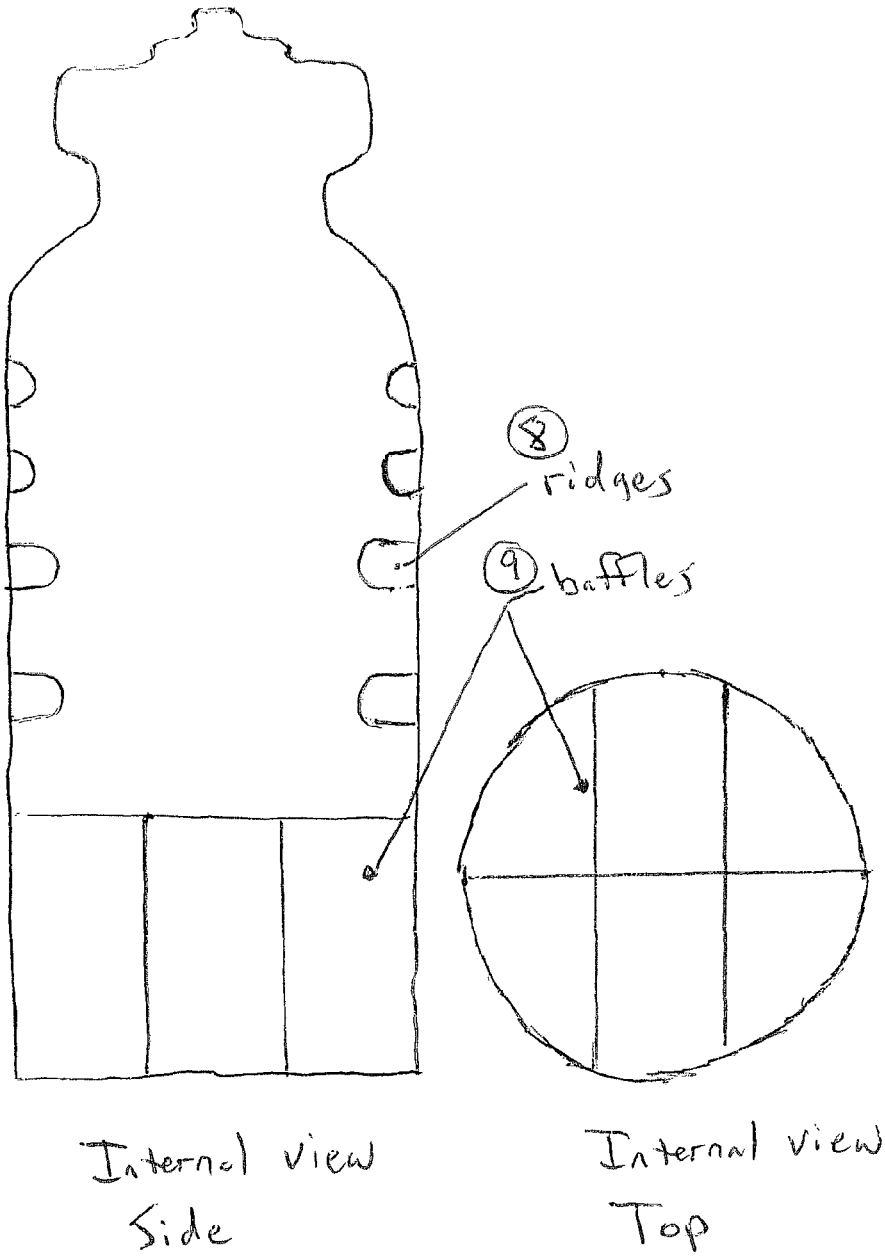
Fig. 3 (cross section)

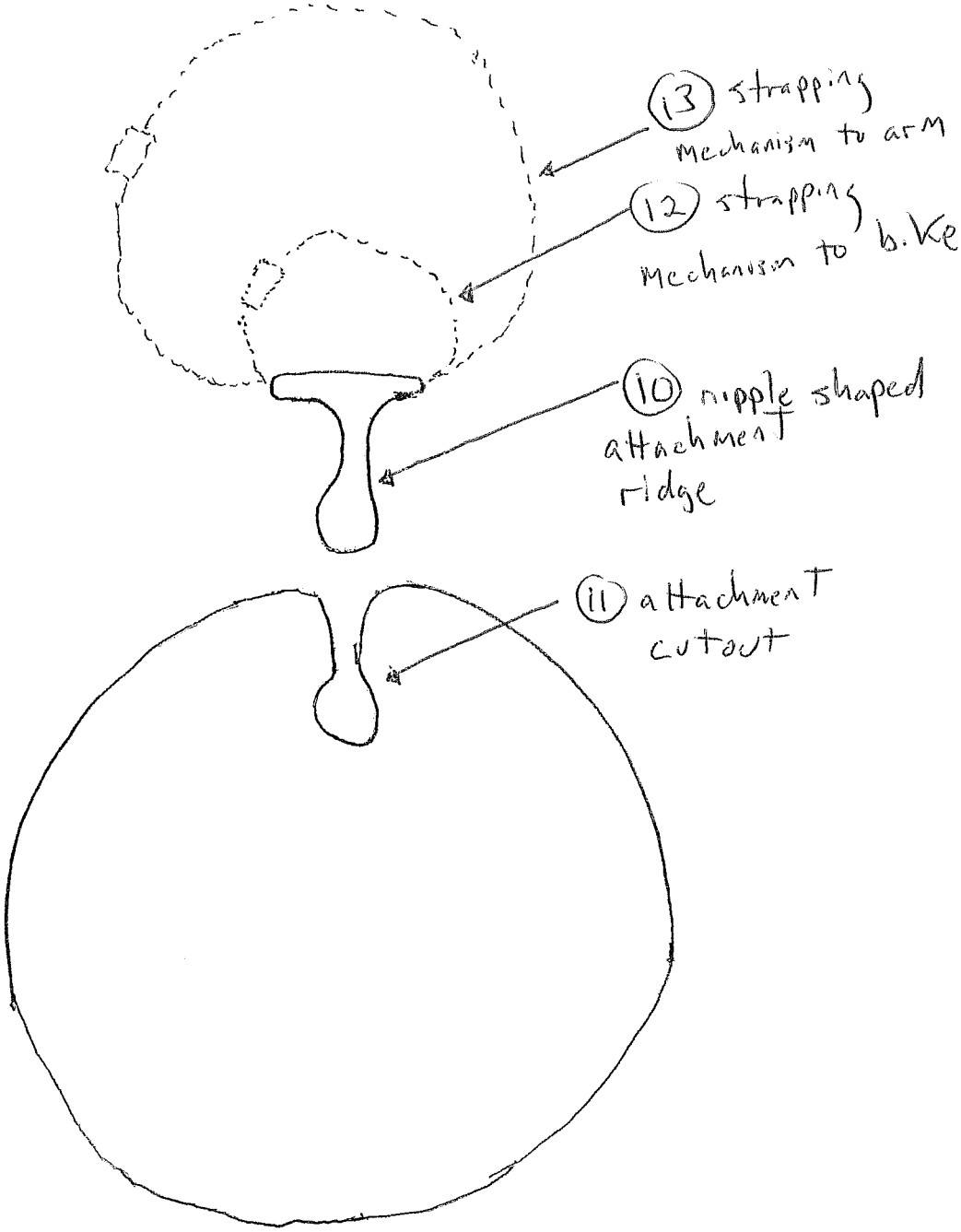
Fig. 4 (Top View)

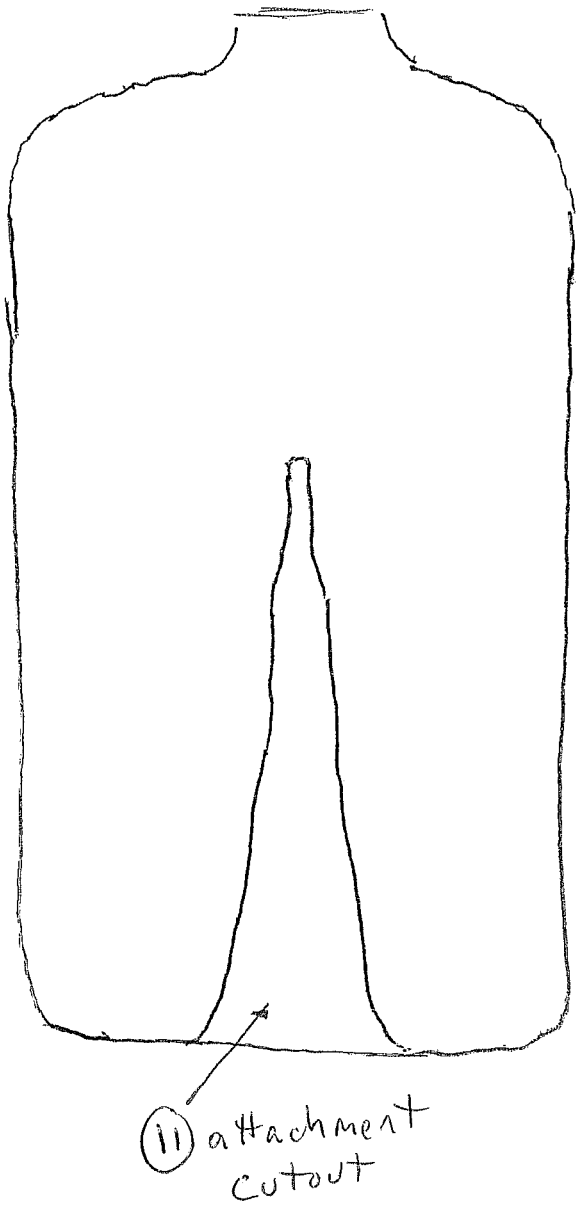
Fig. 5 (rear view)

SYSTEM FOR INTEGRATING A PORTABLE ELECTRONIC DEVICE WITH A BOTTLE OR ARM HOLDER AND FOR MODIFICATION OF BOTTLES

BACKGROUND OF THE INVENTION

1. Field of the Invention

This invention relates to the integration of a portable electronic device with a water bottle or arm holder and the modification of bottles.

2. Background of the Invention

The need for an individual to transport multiple personal items has resulted in the need to integrate these items such that it results in better functionality, less weight, and more stability.

For example, a portable electronic device, such as a mobile phone, MP3 player or Global Positioning Satellite (GPS) device, can be integrated directly into a water-type beverage bottle, resulting in less movement of the individual items, less weight than combining holders, and more stability and ease of use given the on-screen touch operations of portable electronic devices.

As another example, a portable electronic device can be integrated directly into a plastic shell attached to an arm holder to provide a more secure attachment to the arm, the ability to accommodate larger size electronic devices, and better ease of use of the on-screen operations, that eliminates the need of a sleeve that covers the screen of the device.

Water-type beverage bottles can also be modified to include baffles that moderate the movement of water and prevent sloshing while in active/sporting use and the integration of an attachment mechanism directly into the water-type beverage bottle.

SHORTCOMINGS OF THE EXISTING ART

None of the existing prior art discloses or describes an integrated system for a portable electric device or the described modifications to water-type beverage bottles.

The integrated water bottle-type beverage and electronic device support solves the following problems that occur when users seek to jury-rig combinations of an armband phone transportation system and a separately attached bottle or where a belt may contain separate holders for the device and bottle:

A. Excessive movements between the strapping points.

B. Two centers of mass, in which only one center of mass is directly supported by the user's hand, arm, waste or bike.

C. Impedance of movement and negative impact during the athletic endeavor as a result of having two centers of mass, one supporting point, and a center of mass that is far from the supporting point. For example, when jogging, if the bottle is transported with the hand, then the phone tends to bang or hit the waist, the phone swings and moves resulting in distractions and need for additional arm movements and strength. If the bottle is transported by bike, then the phone dangles or can get entangled in the tire or peddling legs.

The second arm holder-type embodiment, in addition to providing unimpeded viewing, access to and operation of the touch screen phone or device, also provides a rigid support that is better integrated, more secure, more durable, with fewer moving attachment points, than existing vinyl or cloth arm-holders. Additional problems are resolved:

A. Existing vinyl phone arm holders are generally not made for and do not work with larger and heavier mobile touch screen phones.

B. Existing phone arm holders completely surround the phone with cloth or vinyl, and in most cases permit movement within the holder. This frequently results in false commands being sent to the phone because the screen or a button is unintentionally pushed as the phone jostles in the holder, particularly in phones with touch-screen controls. When jogging with existing arm holder systems, the screen and buttons are accidentally pushed more frequently, resulting in improper commands to the phone or player, such as phantom calls being sent, or if using as a music player with a Bluetooth type connection, with the music being interrupted, or even with erasure of files or programs. Or, the clear vinyl cover does not adequately transmit a signal to the touch screen phone.

Richardson et al. in U.S. Pat. No. 7,158,376 B2 disclose a protective enclosure that does not permit unimpeded access to the device.

Wakefield in U.S. Pat. No. 5,745,565 discloses a rigid phone holder attached to a beverage holder, but does not integrate them and does not permit attachment to a person.

Wu in U.S. Pat. No. 5,413,261 discloses an external attachment to carry a water bottle, rather than an internal integrated system for an electronic device.

Krause in U.S. Pat. No. 5,669,329 discloses an external clamping mechanism for a water bottle.

Steinke in U.S. Pat. No. 6,065,624 discloses a plastic blow molded water bottle with ridges to provide water bottle structure and stability, but is not specifically designed to prevent sloshing because this is not a problem in an independent bottle.

Michalowski in U.S. Pat. No. 6,695,163 B2 discloses a molded in handle to a water bottle.

Chen in U.S. Pat. No. 7,929,297 B2 disclose an accessory strap fixing structure to a portable electronic device.

Emsky in U.S. Pat. No. 8,016,107 B2 discloses a holder for a portable electronic device, but it does not integrate the holder into a bottle and is does not provide for attachment to the body.

SUMMARY OF THE INVENTION

The present invention is drawn to a system for the integration of a carrier for a portable electronic device and a water-type beverage bottle or arm holder, either embodiment of which permits on-screen touch operations with the device even when the carrier is strapped to the body. Another embodiment is a water-type beverage bottle modified to contain internal baffles and attachment mechanisms.

BRIEF DESCRIPTION OF THE FIGURES

FIG. 1 is a front view illustrating one embodiment consisting of a 1 molded structural shell that is a water bottle, 2 a cutout for an electronic device in the molded structural shell water bottle, 3 and 4 other cutouts for accessing features on the electronic device, 5 a sliding mechanism to lock the 6 pivoting mechanism to the molded structural shell water bottle.

FIG. 2 is a side view illustrating one embodiment of the invention, and which includes 7 insulation between the 1 molded structural shell water-type beverage bottle and the electronic device.

FIG. 3 is a cross-section of a water-type beverage bottle from side ant top views illustrating internal 8 ridges and 9 baffles to moderate sloshing.

FIG. 4 is a top view of an embodiment of the device comprising of a water-type beverage bottle with a molded attachment cutout 11 designed to accept a nipple shaped attachment ridge 10, which can be affixed to a strapping mechanism for a bike 12 or arm 13.

FIG. 5 is a rear view of a water-type beverage bottle illustrating a molded cut-out attachment cutout 11.

DETAILED DESCRIPTION OF THE INVENTION

The present invention is drawn to a device for concurrently holding, displaying and transporting a combination of complementary devices, including one or more portable electronic devices with a water-type beverage bottle or arm holder and the modification of bottles such that on-screen touch operations with the device are readily made even when the device is attached to the body.

One embodiment of the invention as shown in FIGS. 1 and 2 would integrate a mobile phone with a water bottle as shown in the attached drawings. The water bottle embodiment could also include baffles and other modifications to the bottle to prevent a "sloshing effect" that results in vertical and horizontal shifts in weight and momentum to the bottle when it is being transported and when the liquid is being depleted.

Another embodiment of the invention would be as a molded structural shell for holding a mobile phone and integrating it with an arm band to permit transportation on the upper arm for larger phones or a wrist for smaller devices such as MP3 players. The structural support provided permits viewing of and access to the face of the device and associated touch screen operations during such functions as athletic training, while also permitting easy removal of the device to access other components of the phone, to place in a different type of holder or for other reasons.

A water-type beverage bottle can also be modified to contain internal baffles and attachment mechanisms as shown in FIGS. 3, 4 and 5.

EXAMPLES

Now referring to the drawings.

FIG. 1 is a front view illustrating one embodiment consisting of a 1 molded structural shell that is a water bottle, 2 a cutout for an electronic device in the molded structural shell water bottle, 3 and 4 other cutouts for accessing features on the electronic device, 5 a sliding mechanism to lock the 6 pivoting mechanism to the molded structural shell water bottle.

FIG. 2 is a side view illustrating one embodiment of the invention, and which includes 7 insulation between the 1 molded structural shell water-type beverage bottle and the electronic device.

FIG. 3 is a cross-section of a water-type beverage bottle from side ant top views illustrating internal 8 ridges and 9 baffles to moderate sloshing.

FIG. 4 is a top view of an embodiment of the device comprising of a water-type beverage bottle with a molded attachment cutout 11 designed to accept a nipple shaped attachment ridge 10, which can be affixed to a strapping mechanism for a bike 12 or arm 13.

FIG. 5 is a rear view of a water-type beverage bottle illustrating a molded cut-out attachment cutout 11.

Having now fully described this invention, it will be understood to those of ordinary skill in the art that the same can be performed within a wide and equivalent range of conditions, formulations, and other parameters without affecting the scope of the invention or any embodiment thereof. All patents and publications cited herein are incorporated by reference in their entirety.

I claim:

1. A device for concurrently holding, displaying and transporting an electronic device, such as a mobile phone, comprising a) A molded structural shell structured to contain a liquid;

b) Said molded structural shell containing a cutout matching the size and shape of said electronic device;

c) An attachment mechanism for fixedly attaching said electronic device to said molded structural shell;

d) Wherein said attachment mechanism affixes the electronic device to said molded structural shell and allows for ready access to one or more sides of said device;

e) Wherein said attachment mechanism is pivotally attached within said cutout about a pivot axis on one end of the attachment mechanism in order to allow for easy removal and insertion of said electronic device in said molded structural shell.

2. The system according to claim 1 further comprising a locking mechanism for securing each of said electronic device or devices to said molded structural shell.

3. The system according to claim 1 further comprising insulation within said cutout between said shell and said electronic device sufficient to prevent the presence of unwanted condensation and damage to the electronic device.

4. The system according to claim 1 further comprises baffles sufficient to deflect, check, or regulate the flow or passage of said liquids within said molded structural shell.

5. A device for concurrently holding, displaying and transporting a combination of complimentary devices, including one or more electronic devices, such as a mobile phone, comprising;

a) A molded structural shell adapted to be attached to the arm;

b) Said molded structural shell containing a cutout matching the size and shape of said electronic device;

c) An attachment mechanism for fixedly attaching said electronic device to said molded structural shell;

d) Wherein said attachment mechanism affixes the electronic device to said molded structural shell and allows for ready access to one or more sides of said device;

e) Wherein said attachment mechanism is pivotally attached within said cutout about a pivot axis on one end of the attachment mechanism in order to allow for easy removal and insertion of said electronic device in said molded structural shell.

6. The system according to claim 5 further comprising a locking mechanism for securing each of said electronic device or devices to said molded structural shell.

7. The system according to claim 5 further comprising insulation within said cutout between said shell and said electronic device sufficient to prevent the presence of unwanted condensation and damage to the electronic device.

8. A device for securely but movably attaching a bottle adapted to contain liquids to support means comprising:

a) A bottle that is fabricated to contain a liquid;

b) Said bottle fabricated with a wedge-shaped cutout in an outer circumferential wall thereof and also a circular hole at the apex of the wedge-shaped cutout, the diameter of said hole being slightly larger than the width of the cutout at the apex c) Said support means comprising a flat plate with an extrusion on its face forming a stem and an enlarged portion;

d) The diameter of the stem of said extrusion designed to fit into said circular hole in the apex of the wedge-shaped cutout.

* * * * *